United States Patent [19]

Van Klompenburg

[11] 4,095,829

[45] Jun. 20, 1978

[54] WINDOW LOCK

[75] Inventor: Marlo G. Van Klompenburg, Owatonna, Minn.

[73] Assignee: Truth Incorporated, Owatonna, Minn.

[21] Appl. No.: 755,187

[22] Filed: Dec. 29, 1976

[51] Int. Cl.[2] ..... E05C 3/08

[52] U.S. Cl. ..... 292/241; 292/26

[58] Field of Search ..... 292/240, 241, 100, 126, 292/200, 197, 226, 26, 30, 36, 48, 113

[56] References Cited

U.S. PATENT DOCUMENTS

| | | | |
|---|---|---|---|
| 539,030 | 5/1895 | Bitner | 292/240 X |
| 2,140,570 | 12/1938 | Young | 292/26 |
| 2,708,301 | 5/1955 | Wilkerson | 292/240 X |

*Primary Examiner*—Richard E. Moore

*Attorney, Agent, or Firm*—Wegner, Stellman, McCord, Wiles & Wood

[57] ABSTRACT

A window lock having a base with a rotatable cam member engageable with a keeper for locking windows, such as a double hung window and a handle member rotatable in generally the same direction as the cam member for moving the cam member between retracted and extended lock positions with motion-transmitting means between the handle member and cam member providing for movement of the handle member through a greater arc of movement than the cam member. Structurally interengaging parts function when the cam member is in extended locked position to prevent any movement of the cam member from the locked position by a force applied thereto other than by rotation of the handle member. The window lock, by means of connecting link means to a second cam member, provides a dual window lock with operation of both cam members from a single handle member.

13 Claims, 8 Drawing Figures

WINDOW LOCK

BACKGROUND OF THE INVENTION

This invention pertains to window locks usable with windows having relatively movable sections, such as a horizontal sliding window, casement window, or a double hung window, and having structure improving the esthetic appearance and action of the lock, with improved locking action and with dual window lock capability.

Window locks having a rotatable cam member movable into engagement with a keeper are well known in the art and have been in wide use. Most commonly, the cam member is rotatably mounted on a base and has a finger-engaging surface thereon for rotating the cam member. Such a window lock, located at the check rails of a window, provides only limited security protection because the cam member can be rotated by either rocking the sash or by obtaining access to the cam by inserting a sharp tool through the weather stripping area between the window sash. Additionally, the conventional type of window lock does not force the check rails of adjacent sash to be parallel to each other, nor is the weather stripping tightly drawn together to form an airtight seal. Attempts to overcome this include mounting of two of the window locks at laterally-spaced positions on one of the sash. However, each window lock must be independently operated and each window lock is still subject to the same limited security protection.

SUMMARY

A primary feature of the window lock disclosed herein is to provide a structure which tightly draws the check rails of adjacent window sashes tightly together to form a good weather stripping seal and which provides good security protection since the cam member of the window lock is retained in extended lock position and can not be moved therefrom by a force applied thereto except by rotation of the operating handle member.

An additional feature of the invention is to provide a window lock as described in the preceding paragraph which has certain parts thereof duplicated in a second unit and with the two units being interconnected by link means whereby the two units may be mounted at laterally-spaced locations on a check rail for forcing the check rails to be parallel and the weather stripping to be drawn tightly together throughout the length of the meeting check rails and with the operation of the pair of cam members being from a single operating handle member.

An additional feature of the invention is to provide a window lock wherein the cam member is rotatable through approximately 90° between a retracted position and an extended lock position in association with a keeper and with a handle member for operation of the cam member being rotatable about the same axis as the cam member and movable through an arc of approximately 180° whereby the handle member may be in either of two positions extending generally parallel to the meeting line of the check rails of the window and thus avoid the possibility of the handle member protruding into a room area in either open or lock position of the window lock.

Still another feature of the invention is to provide a window lock, as defined in the preceding paragraph, wherein the cam member and handle member are interconnected by motion-transmitting means including a lost motion connection enabling greater rotation of the handle member than the cam member and with this lost motion connection enabling final movement of the handle member, after moving the cam member to extended lock position, to bring a peripheral detent surface on the handle member into engagement with an upstanding lug carried by the base of the window lock to provide a structural relation between the handle member, cam member, and the base whereby any force applied to the cam member in a direction to move the cam member to retracted position is ineffective to accomplish such movement and with the only movement for opening the window lock being derived from rotation of the handle member.

DESCRIPTION OF THE PREFERRED EMBODIMENT

Figure 1:
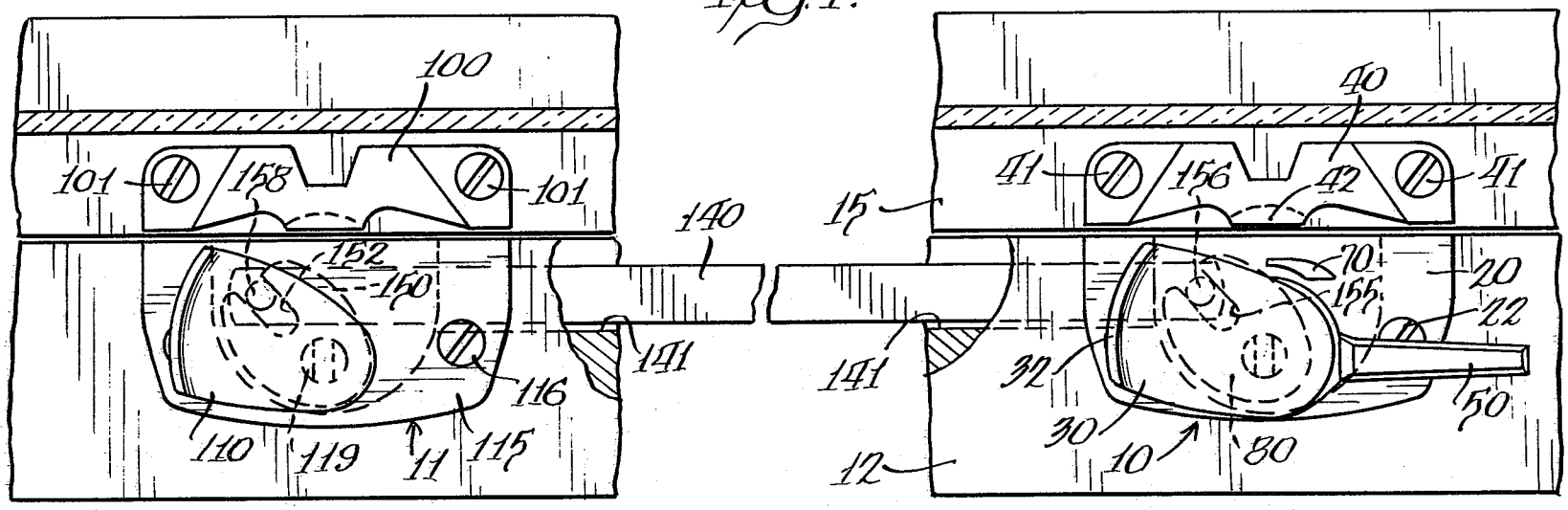
FIG. 1 is a plan view, showing the dual window lock structure mounted on parts of a window and with parts broken away.
Figure 2:
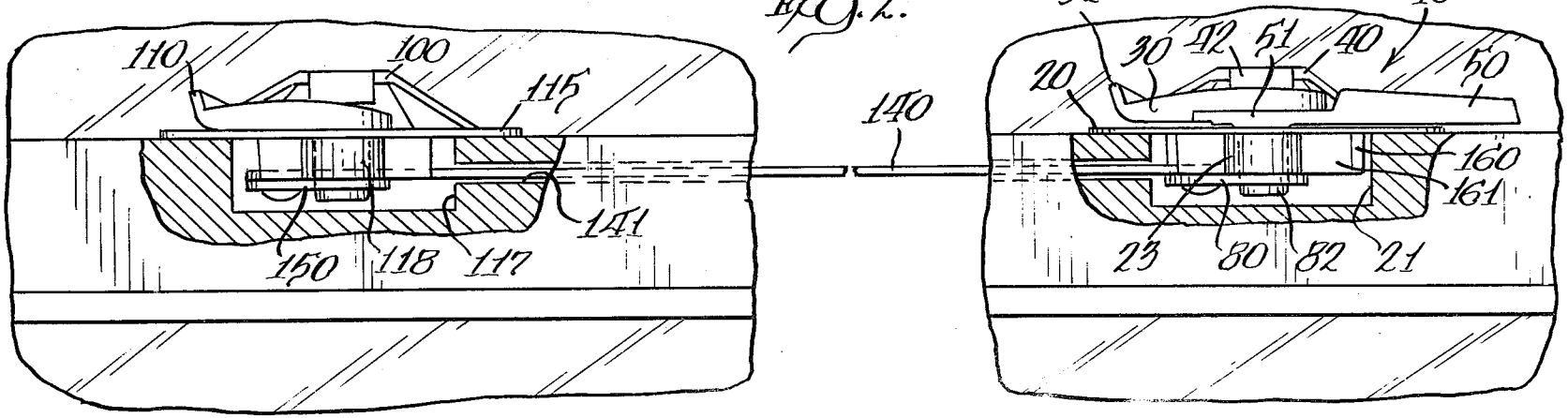
FIG. 2 is an elevational view of the dual window lock shown in FIG. 1 and with parts of the window structure broken away to expose the dual window lock structure.

The dual window lock is shown in FIGS. 1 and 2 and includes a primary unit, indicated generally at 10, and a secondary unit, indicated generally at 11, with these units being shown mounted on a check rail 12 of a sliding window section, such as a window sash of a double hung window and for coaction with keepers mounted on a check rail 15 of an adjacent window sash.

The primary unit 10 is shown in detail in FIGS. 3 to 8 and reference may be made thereto for the following description.

The primary window lock unit 10 has a base with a base plate 20 positioned in overlying relation to a recess 21 formed in the check rail 12 and having parts thereof flush with the check rail to either side of the recess for receiving attaching means 22 for securing the window lock to the check rail.

An integral tubular base section 23 extends downwardly from the base plate 20 to define a rotational axis for parts of the window lock rotatably mounted on the base.

A cam member 30 is rotatably mounted on the base by center post means positioned within the tubular extension 23 of the base and with this center post means specifically being provided by an integral hub 31 extending downwardly from the cam member 30. The cam member 30 is shown in retracted position in FIGS.

Figure 5:
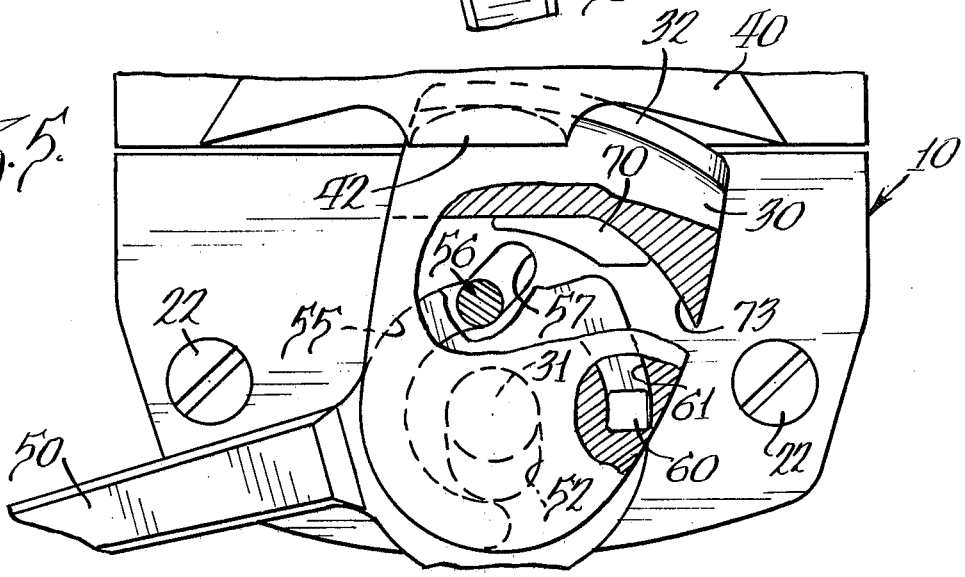
FIG. 5 is a view, similar to FIG. 3, showing the parts positioned prior to final movement of the handle member.
Figure 6:
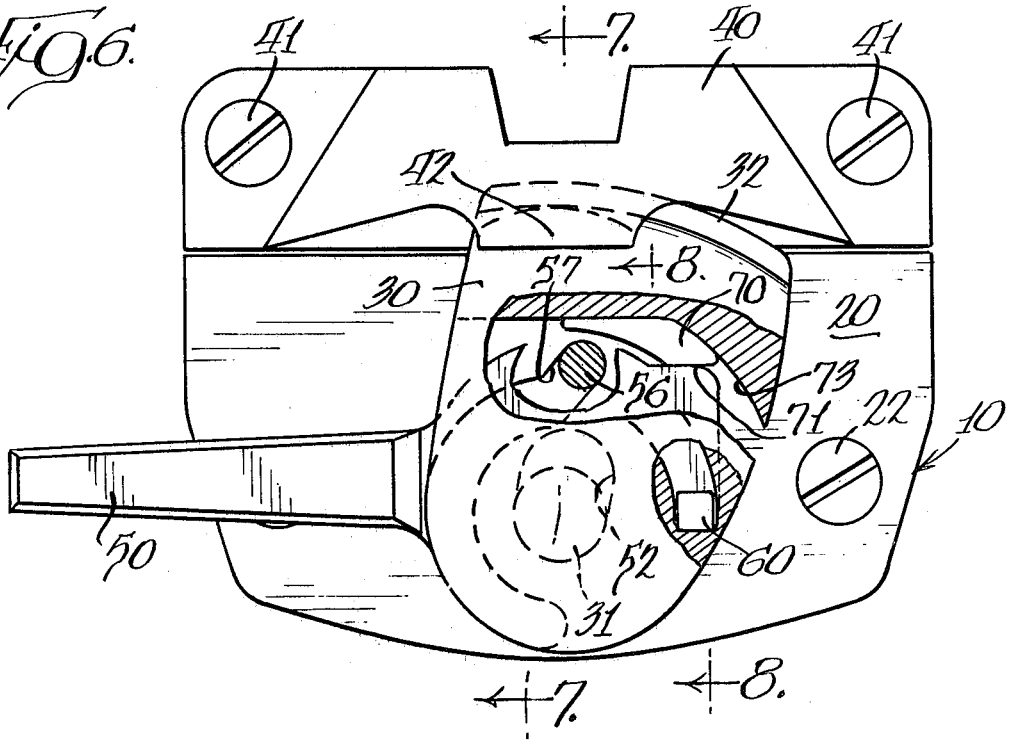
FIG. 6 is a view, similar to FIGS. 3–5, showing the window lock in locked position and with parts broken away.
Figure 7:
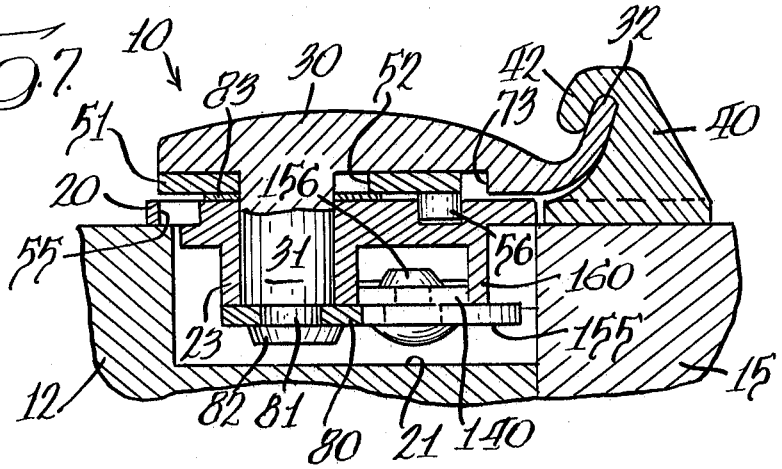
FIG. 7 is a vertical section, taken generally along the line 7—7 in FIG. 6.
Figure 8:
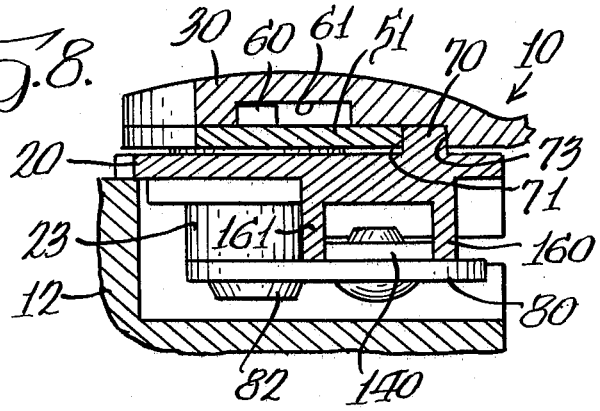
FIG. 8 is a vertical section, taken generally along the line 8—8 in FIG. 6.

3 and 4 and in extended lock position in FIGS. 5 and 6. In moving between these positions, the cam member moves through approximately ¼ revolution or approximately 90° of rotation. In moving to extended lock position, an inclined ramp 32 is moved into coacting relation with a keeper 40 secured to the check rail 15 by means of attachment means 41. The keeper has a downturned end 42 (FIG. 7) defining a groove to receive the inclined ramp 32 of the cam member therebeneath. The inclination of the inclined ramp 32 of the cam member coacts with the base of the keeper groove to impart a force urging the check rail 15 upwardly and the check rail 12 downwardly and with the inclined ramp 32 also having a curvature viewed in plan which results in a terminal end 32a of the ramp being closer to the integral hub 31 than a leading end 32b of the ramp whereby there is also a force acting to draw check rails 12 and 15 toward each other.

Figure 3:
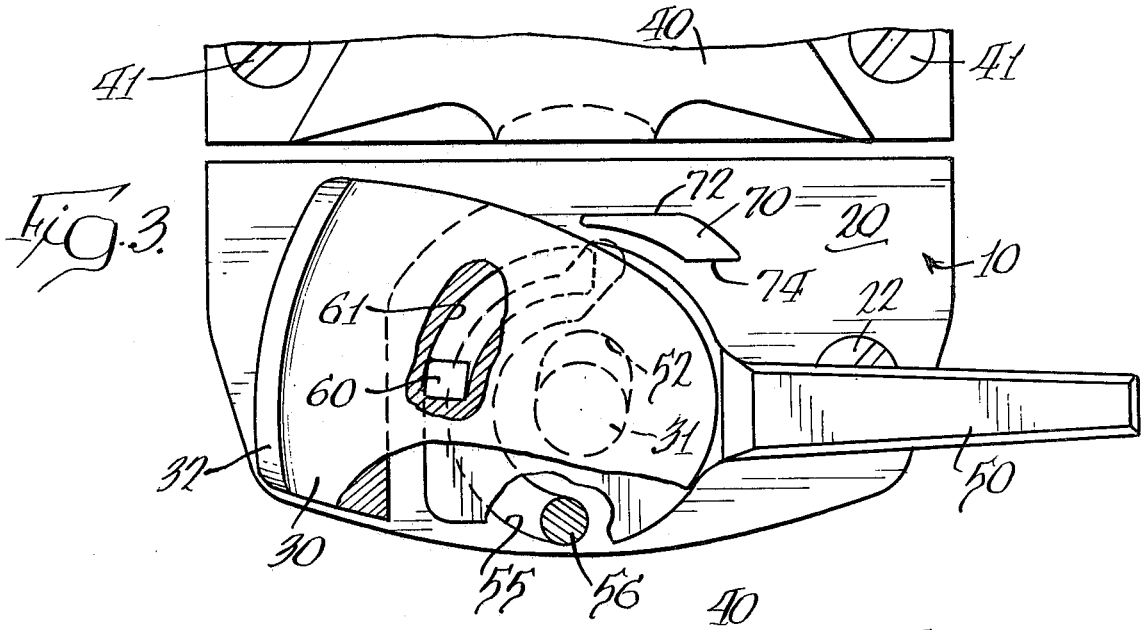
FIG. 3 is a plan view of the primary window lock structure in unlocked position and with parts broken away.
Figure 4:
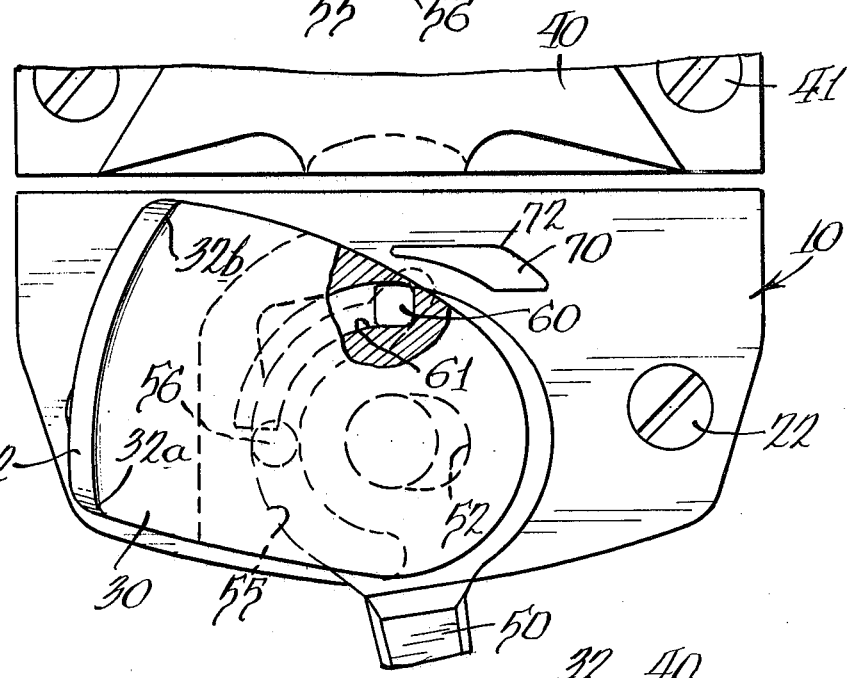
FIG. 4 is a view, similar to FIG. 3, showing the parts positioned after initial movement of a handle member and with parts broken away.

A handle member 50 is movable through approximately ½ revolution or 180° of rotation from a position of FIG. 3 wherein the window lock is unlocked and the position of FIG. 6 wherein the window lock is in lock position. The handle member in moving from the position of FIG. 3 to the position of FIG. 6 has additional significant positions, as illustrated in FIGS. 4 and 5. The handle member has a generally planar section 51 positioned between the cam member 30 and the base plate 20 and which has an elongate slot 52 located generally centrally thereof providing rotational mounting for the handle member on the integral hub 31. The guiding of the handle member during rotation thereof is provided by an arcuate slot 55 provided in the base plate which coacts with a guide pin 56 integral with the planar handle part 51 and extending downwardly therefrom. The arcuate slot 55 has a first curved section concentric with the rotational axis defined by the integral hub 31 for rotationally guiding the movement of the handle member from the position of the guide pin 56, shown in FIG. 3, to the position of the guide pin shown in FIG. 5. There is an additional terminal section 57 of the slot which extends away from the rotational axis of the structure for laterally guiding movement of the handle member from the position shown in FIG. 5 to the final position shown in FIG. 6.

The handle member 50 and the cam member 30 have motion-transmitting means therebetween including a lost motion connection, with this structure including an integral pusher pin 60 extending upwardly from the planar part 51 of the handle member and loosely positioned within an arcuate slot 61 formed on the underside of the cam member 30 and having an arcuate extent of approximately 90°.

With the above-described structure, basic movements of the primary window lock unit 10 may now be described.

When it is desired to lock the window, the handle 50 is rotated clockwise, as viewed in FIG. 3, with the movement of the handle member to the position shown in FIG. 4 not causing any movement of the cam member 30 because the pusher pin 60 is merely moving from one end of the arcuate slot 61 to the other end thereof, as viewed in FIGS. 3 and 4. With further movement of the handle member clockwise from the position shown in FIG. 4, the pusher pin 60 causes rotation of the cam member 30 with rotation of the handle member 50 being controlled by movement of the guide pin 56 in the concentric part of the arcuate slot 55. This movement to the position shown in FIG. 5 brings the cam member 30 in full locked relation with the keeper 40. Final movement of the handle member 50 to the position shown in FIG. 6 does not result in any rotational movement of the cam member 30 but does result in a lateral shift of the handle member resulting from the pusher pin 60 being held in position by engagement with an end of the slot 61 in the cam member and the guide pin 56 moving along the terminal section 57 of the arcuate slot 55. This movement is permitted by the shape of the elongate slot 52 in the planar part 51 of the handle member which is fitted on the integral hub 31. This final movement brings the structure into a secure lock position whereby any forces applied to the cam member 30 prevent movement thereof from the locked position except for a force applied by counterclockwise rotation of the handle member 50. The secure lock structure includes an upstanding lug 70 on the base plate 20 and a peripheral detent surface 71 on the planar part 51 of the handle member.

The upstanding lug 70 has an outer face 72 shaped to coact with a face 73 extending downwardly from the under surface of the cam member 30 and has an inner face 74 for coaction with the peripheral detent surface 71. With the parts positioned as shown in FIG. 5, the cam member 30 is in extended lock position with the surface 73 thereof in contact with the surface 72 of the upstanding lug 70 whereby further clockwise rotation of the cam member 30 is not possible. This provides a fixed location for the pusher pin 60 whereby the final movement of the handle member 50 to the position of FIG. 6 causes the guide pin 56 to move in the terminal section 57 of the arcuate slot and bring the detent 71 into engagement with the surface 74 of the upstanding lug. This structural relation of the parts, as shown in FIG. 6, effectively locks the cam member 30 against counterclockwise rotation by forces applied thereto since, at this time, the guide pin 56 is at the end of the terminal section 57 of the arcuate slot and the peripheral detent surface 71 is engaged against the upstanding lug 70 whereby the pusher pin 60 cannot be moved and, thus, the cam member 30 is held locked. Counterclockwise rotation of the handle member 50 from the position shown in FIG. 6 shifts the guide pin 56 along the terminal section 57 of the arcuate slot to remove the peripheral detent surface 71 from engagement with the upstanding lug 70 and further counterclockwise rotation of the handle member 50 causes movement of pusher pin 60 counterclockwise until an end of arcuate slot 61 is reached and then the cam member 30 is rotated to retracted position.

With the lost motion connection provided by the pusher pin 60 and the arcuate slot 61, it will be noted that the handle member 50 can be positioned in either the position of FIG. 3 or the position of FIG. 6 and avoid extension into the room area and with the lost-motion connection also enabling the lateral shift of the handle member to the fully locked position of FIG. 6.

The components of the primary window lock unit 10 are held together by a member 80 forming part of link means interconnecting the primary unit and secondary unit 11, with this member having an opening non-rotatably fitted on a reduced part 81 at the lower end of the hub 31 and secured thereto by an enlarged end 82. A spring washer 83 may be positioned between the planar part 51 of the handle member and the base plate 20 to exert forces on the parts axially of the hub 31 whereby frictional forces will hold the handle member 50 in a desired position.

The secondary unit 11 has a keeper 100 of the same construction as the keeper 40 and secured to the check rail 15 by attachment means 101 and a cam member 110 of the same construction as the cam member 30 of the primary unit. A base plate 115 is attached to the check rail 12 by attachment means 116 and overlies a recess 117 in the check rail 12 whereby a depending tubular extension 118 integral therewith rotatably mounts an integral hub 119 of the cam member 110. Movement of the cam member 110 is derived from movement of the cam member 30 by link means including an elongate link 140 fitted within a slot 141 formed in the check rail 12 and extending between the member 80 of the primary unit 10 and a similar member 150 of the secondary unit 11. The member 150 is secured to the integral hub 119, similarly to the connection of the member 80 to the integral hub 31. Rotational movement of the member 80 is converted to linear movement of the elongate link 140 and back to rotational movement of the member 150 by means of pin and slot connections at each end of the link 140 and the adjacent ones of the members 80 and 150. As shown in FIG. 1, the member 80 has a slot 155 coacting with a pin 156 on the elongate link 140 and the member 150 has an elongate slot 157 coacting with a pin 158 on the elongate link 140.

With the primary unit 10 and secondary unit 11 mounted at laterally-spaced locations on the check rail 12, rotation of the handle member 50 in a clockwise direction will bring the cam members 30 and 110 into locked relation with their respective keepers 40 and 100. Inasmuch as the cam member 30 is securely locked when in locked position, the same is also true with respect to the cam member 110. The elongate link 140 is guided for linear movement by guide structure associated with each of the base plates 20 and 115, with this structure for the base plate 20 being shown particularly in FIGS. 7 and 8. A pair of spaced-apart, elongate, depending walls 160 and 161 receive the elongate link 140 therebetween.

I claim:

1. A window lock having a cam member engageable with a keeper, comprising, a base, said cam member being rotatably mounted on said base for rotational movement only about a fixed axis between a retracted position and an extended lock position, a handle member mounted on said base for rotational movement generally about said axis, and motion-transmitting means including a lost motion connection between said handle member and cam member whereby initial rotation of the handle member toward either of two positions at either side of said axis does not cause any movement of the cam member to result in a lesser rotation of said cam member between retracted and extended positions.

2. A window lock having the structure of claim 1 and further including a second base, and a second cam member, link means interconnecting said cam member for simultaneous movement thereof between retracted and extended positions to form a dual window lock, said link means including an elongated link, a pair of members rotatable one with each cam member, and a pair of pin and slot connections between said link and said pair of members, and guide means on each base guiding said link for straight-line movement.

3. A window lock as defined in claim 1 including interengaging means on each of said base, cam member and handle member preventing movement of the cam member from the extended lock position except by rotation of the handle member.

4. A window lock having a cam member engageable with a keeper comprising, a base, said cam member being rotatably mounted on said base for movement about an axis between a retracted position and an extended lock position, a handle member mounted on said base for rotational movement generally about said axis, motion-transmitting means including a lost motion connection between said handle member and cam member whereby movement of the handle member to either of two positions at either side of said axis causes a lesser rotation of said cam member between retracted and extended positions, and interengaging means on each of said base, cam member and handle member preventing movement of the cam member from the extended lock position except by rotation of the handle member, said interengaging means including an upstanding lug on said base and a detent surface on said handle member.

5. A window lock as defined in claim 4 wherein a center post extends upwardly from said base and said handle member has an elongate slot receiving said post for guiding said handle member in said rotational movement thereof, a slot in said base having an arcuate section concentric with said center post and a terminal section directed away from said axis, a pin depending from said handle member engaged in said base slot whereby the pin in the arcuate section of the base slot guides the handle member for rotation and movement of the pin in the terminal section of the base slot in response to force applied to the handle causes the handle member to shift by movement of the handle member slot on the center post and engage the detent surface on the handle member with said lug.

6. A window lock having a cam member engageable with a keeper comprising, a base, said cam member being rotatably mounted on said base for movement about an axis between a retracted position and an extended lock position, a handle member mounted on said base for rotational movement generally about said axis, motion-transmitting means including a lost motion connection between said handle member and cam member whereby movement of the handle member to either of two positions at either side of said axis causes a lesser rotation of said cam member between retracted and extended positions, said member having an integral hub extended through an opening in said base to provide said rotation about said axis, said handle member being positioned between said base and the cam member and rotatably guided by said hub, and a member secured to the lower end of the hub to hold the window lock structure in assembled relation.

7. A window lock as defined in claim 1 wherein said lost motion connection includes a pin and slot connection.

8. A window lock having a base with a central opening and an upstanding lug, a handle member overlying said base and a cam member overlying said handle member, center post means in said central opening and guiding said cam member for rotation about an axis between a retracted position and an extended position, said handle member being rotatably and loosely mounted on said center post means and having a detent surface, motion transmitting means between said handle member and cam member whereby movement of the handle member moves said cam member to extended position, and coacting means on said base and handle member for causing said handle member to move laterally of said center post after the cam member is extended in response to manually applied force to position said detent surface in locking engagement with said lug.

9. A window lock as defined in claim 8 wherein said motion-transmitting means includes a lost motion connection whereby said handle member may rotate approximately 180° while the cam member rotates approximately 90°.

10. A window lock as defined in claim 9 wherein said center post means comprises a hub integral with said cam member.

11. A window lock having the structure of claim 9 and further including a second base, and a second cam member and link means interconnecting said cam members for simultaneous movement thereof between retracted and extended position to form a dual window lock.

12. A window lock as defined in claim 11 wherein said link means includes an elongate link, a pair of members rotatable one with each cam member, and a pair of pin and slot connections between said link and said pair of members, and guide means on each base guiding said link for straight-line movement.

13. A window lock comprising a base having a plate member with an opening therein and an upstanding lug, a cam member with an integral hub positioned in said opening for rotation of the cam through approximately ¼ revolution between retracted and extended positions, a handle member positioned between said base plate and cam member with a peripheral detent surface and having an opening loosely receiving said hub, a slot in said base plate having an arcuate section concentric with said hub and a terminal section directed away from said hub and toward said lug, a guiding pin depending from said handle member and engageable in said slot whereby rotation of the handle member through approximately ½ revolution moves said guide pin in the arcuate section of the slot and additional movement of the handle member causes the guide pin to move in said slot terminal section and bodily shift said handle member to move the detent surface into engagement with said lug, and a motion-transmitting connection between said handle member and cam member including a pusher pin on said handle member engaging an arcuate slot in said cam member which is concentric with the hub and extends for approximately 90° to provide a lost motion connection to have movement of the handle member result in lesser movement of the cam member, and each of said guide pin, pusher pin detent surface and upstanding lug being positionally related whereby the cam member when in said extended position can not be moved to retracted position by any force other than that applied by rotation of the handle member.

* * * * *